US008191560B2

(12) United States Patent
Mallory et al.

(10) Patent No.: US 8,191,560 B2
(45) Date of Patent: Jun. 5, 2012

(54) ADJUSTABLE UPPER DISHWASHER RACK

(75) Inventors: Brian L. Mallory, Louisville, KY (US); Errin Whitney Gnadinger, Louisville, KY (US); Rajdeep Das, Bangalore (IN); Vasudev Mallur, Bangalore (IN); Elizabeth Beard, Baton Rouge, LA (US); Srinivasan Ramakrishnan, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 404 days.

(21) Appl. No.: 12/482,951

(22) Filed: Jun. 11, 2009

(65) Prior Publication Data

US 2010/0314977 A1 Dec. 16, 2010

(51) Int. Cl.
*B08B 3/02* (2006.01)

(52) U.S. Cl. ..... 134/145; 211/41.8

(58) Field of Classification Search ..... 134/135; 312/311; 211/41.8, 41.9
See application file for complete search history.

(56) References Cited

U.S. PATENT DOCUMENTS

| | | | | | |
|---|---|---|---|---|---|
| 3,269,548 | A | * | 8/1966 | Geiger et al. | 211/41.8 |
| 3,466,109 | A | * | 9/1969 | Kauffman et al. | 312/228.1 |
| 3,556,625 | A | * | 1/1971 | Kauffman | 312/301 |
| 3,558,103 | A | * | 1/1971 | Lodige | 254/122 |
| 3,809,451 | A | * | 5/1974 | Pitstick | 312/351 |
| 3,934,728 | A | * | 1/1976 | Guth | 211/41.9 |
| 4,064,887 | A | * | 12/1977 | Geiger et al. | 134/144 |
| 4,097,099 | A | * | 6/1978 | Spiegel | 312/311 |
| 5,409,309 | A | * | 4/1995 | Giddings et al. | 312/331 |
| 5,474,378 | A | * | 12/1995 | Smith et al. | 312/334.4 |
| 5,595,200 | A | * | 1/1997 | Favaro | 134/201 |
| 5,601,195 | A | * | 2/1997 | Finola et al. | 211/41.8 |
| 5,657,878 | A | | 8/1997 | Austin | |
| 5,860,716 | A | * | 1/1999 | Good et al. | 312/311 |
| 6,247,771 | B1 | | 6/2001 | Miller | |
| 6,546,942 | B2 | * | 4/2003 | Smith et al. | 134/201 |
| 6,974,040 | B2 | | 12/2005 | Jährling | |
| 7,410,228 | B2 | * | 8/2008 | Dickson et al. | 312/311 |
| 2005/0016941 | A1 | * | 1/2005 | Neff et al. | 211/41.9 |
| 2005/0039782 | A1 | * | 2/2005 | Kim | 134/58 D |

FOREIGN PATENT DOCUMENTS

| | | | |
|---|---|---|---|
| JP | 2000-217770 | * | 8/2000 |
| JP | 2000-217779 | * | 8/2000 |
| JP | 2002-355213 | * | 12/2002 |
| JP | 2004-000745 | * | 1/2004 |
| JP | 2004-242901 | * | 9/2004 |
| JP | 2006-006765 | * | 1/2006 |
| JP | 2007-313139 | * | 12/2007 |
| JP | 2008-073400 | * | 4/2008 |
| JP | 2009-066283 | * | 4/2009 |

OTHER PUBLICATIONS

WIPO WO 00/49936 Aug. 2000.*

* cited by examiner

*Primary Examiner* — Frankie L Stinson
(74) *Attorney, Agent, or Firm* — Fay Sharpe LLP

(57) ABSTRACT

An upper rack vertical adjustment system for a dishwasher, including an upper rack first portion, and an upper rack second portion rotatably attached to the first portion to selectively create an opening in the bottom of the rack to provide clearance for items placed in the lower rack. For adjusting the height of the upper rack, a slidable member has two elongated arms extending therefrom each having a wheel attached at an end of the arms is provided on each side of the rack. For each slidable member, a plate is mounted to a portion of the upper rack and the said slidable member is pivotally mounted to the plate. A locking mechanism locks the slidable member in one of several predetermined positions.

25 Claims, 8 Drawing Sheets

ADJUSTABLE UPPER DISHWASHER RACK

BACKGROUND OF THE DISCLOSURE

Present adjustable height mechanisms for dishwasher racks generally use a screw type of adjustment which can be somewhat slow and cumbersome for larger adjustments in height. Moreover, the adjustable height assembly must be physically fastened or attached by screws or like fasteners to the rack, which takes some time and care in installation. Also, present mechanisms require the use of two different assemblies, one configured for each side of the rack. Thus, installers are required to maintain a supply of both left-hand and right-hand adjustable height assemblies and properly select and install one of each on each dishwasher rack in the assembly process. Moreover, this requires that both types of assemblies and their constituent parts be inventoried and handled separately. This may also require separate inventorying and handling of two sets of subassembly parts for the respective height adjustment assemblies and the proper assembly of each prior to assembly of the completed adjustment mechanisms with respective right-hand and left-hand sides of the dishwasher rack. One commonly used approach employs a T-bracket and lever system that allows for no more than 1 inch of vertical adjustment for the upper rack. Typical vertical adjustment systems that use a lever system have a 1:1 ratio between the vertical displacement of the upper rack and T-bracket movement.

Existing rack systems allow for at most a 10-inch plate to fit in the upper rack. The upper rack can only be displaced up to 1 inch, which only allows for a 10-inch plate to fit on the rack. Thus, there is a need for a lever-actuated vertical adjustment system which is used on both the left and right sides of the upper rails and allows for more vertical rack displacement than existing lever-actuated systems, such as allowing for a 3-inch vertical rack displacement which allows the consumer to place a 12-inch plate in the upper rack.

Existing rack systems allow tall items (i.e., greater than approximately 13 inches) to be loaded vertically on a side of bottom rack by requiring removal of entire upper rack, and allow loading of the tall items by possibly obstructing the intended free-sliding motion in and out of the upper rack system. Thus, there is also a need for a foldaway upper rack portion which allows a portion of the upper rack to be rotated so that tall items can be placed in the bottom rack and a portion of the upper rack to remain in place and still be used.

BRIEF DESCRIPTION OF THE DISCLOSURE

An upper rack vertical adjustment system for a dishwasher includes an upper rack first portion, an upper rack second portion rotatably attached to the first portion; wherein the second portion is attached to the first portion via a hinge.

An upper rack vertical adjustment system includes a slidable bracket having two elongated arms extending therefrom wherein each of the elongated arms includes a wheel attached at an end of the arms; a plate mounted to a portion of the upper rack wherein the slidable bracket is pivotally mounted to the plate; and a locking mechanism for locking the slidable bracket in one of several predetermined positions.

The present disclosure concerns an adjustable height apparatus for a dishwasher rack which offers a relatively simple and easy to use height adjustment, and is relatively simple to install during rack and dishwasher assembly. Preferably, the adjustable height apparatus of the invention is of a symmetrical design such that the same apparatus may be installed upon both left-hand and right-hand sides of the rack, thus further increasing the ease of installation and simplifying the inventory and parts handling process.

The present disclosure uses a lever-actuated system that allows for vertical adjustment of the upper rack through a system of brackets and rivets to provide an unequal ratio between vertical displacement of the upper rack and movement of the slide bracket and wheels, thus allowing greater vertical wheel displacement than other existing lever-actuated designs.

One aspect of the disclosure is to allow for the consumer to place a 12-inch plate into the upper rack, thus providing more dishwasher loading options to the consumer. Existing designs for vertical upper-rack adjustment allows for the consumer to adjust the upper rack with a 1-inch displacement which allows for no more than a 10-inch plate to be placed in the rack.

Another aspect of the disclosure is a spring lever system and vertical adjustment which can be set at any ratio configuration that geometrically fits the upper rack's design.

Still another aspect of the disclosure is a removable or foldaway side portion of upper rack to accommodate tall and large area items which would be positioned on a side of the bottom rack, and would still allow in/out sliding motion of upper rack while tall items are present.

Yet another aspect of the disclosure is the ability to load tall items (e.g., greater than approximately 13 inches) vertically on side of bottom rack without requiring removal of upper rack, and to allow loading of the tall items without obstructing the intended free-sliding motion in and out of the upper rack system. The foldaway rack can have a clip or some fastening mechanism which is detached then the moving portion of the rack is rotated 90 degrees on a pivot axis made with the wire rack forms. The rack could also use, as an alternative to the rotating design, a design in which a clip or some fastening mechanism is detached and the moving portion of the rack is lifted or pulled out of place completely.

DETAILED DESCRIPTION OF THE DISCLOSURE

For cases of large roast pans or large, flat baking sheets, most current rack designs allow the upper rack to be fully removed, thus eliminating the loading space for a large portion of glasses and other dishware that is otherwise provided by the upper rack. Furthermore, current rack and silverware basket designs do not provide a convenient means to load long utensils without obstruction of a mid spray arm, obstruction of the sliding motion of upper rack, or awkward placement of utensils across an upper or lower rack.

The mechanism of the present disclosure allows loading of tall utensils in a defined space in a manner that does not obstruct the mid spray arm or sliding motion of the upper rack, and does not have an awkward fit and appearance. The mechanism allows a portion of the rack to be removed, on one side or the other to allow clearance for tall items to be loaded and washed such as long grill spatulas (and other long utensils), large cookie sheets, and large roasting pans. The mechanism allows these items to be loaded onto the bottom rack on a side, vertically, and to utilize the space that is typically occupied by a portion of upper rack, while allowing the remaining portion of the upper rack to remain and to be used for loading of glasses and other dishes typically loaded into an upper rack. Secondly, a tall item plastic or wireform cage can be provided which sits or mounts to bottom rack and utilizes the clearance space from the removable upper rack. The cage can be used for very tall spatulas and utensils, and keeps tall items within a defined space to allow easy sliding motion of upper rack, and to prevent tall utensils from falling out of the intended space.

Figure 1:
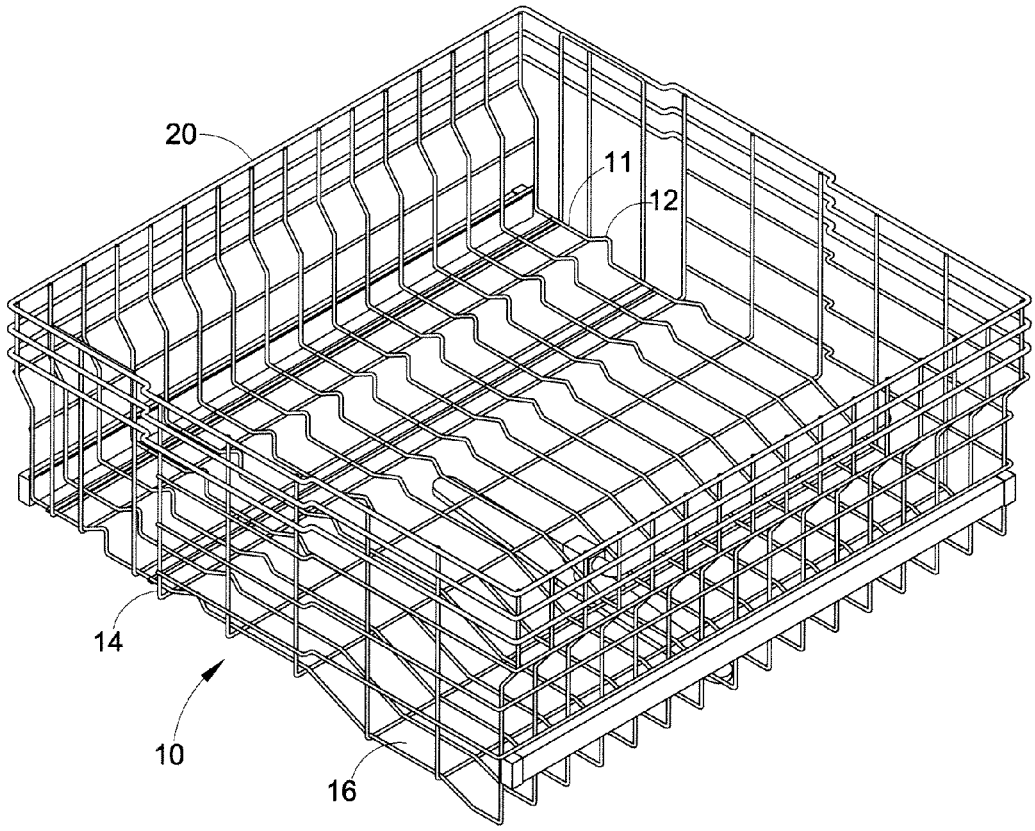
FIG. 1 shows a perspective view of a foldaway upper rack in a closed position according to one aspect of the present disclosure.
Figure 2:
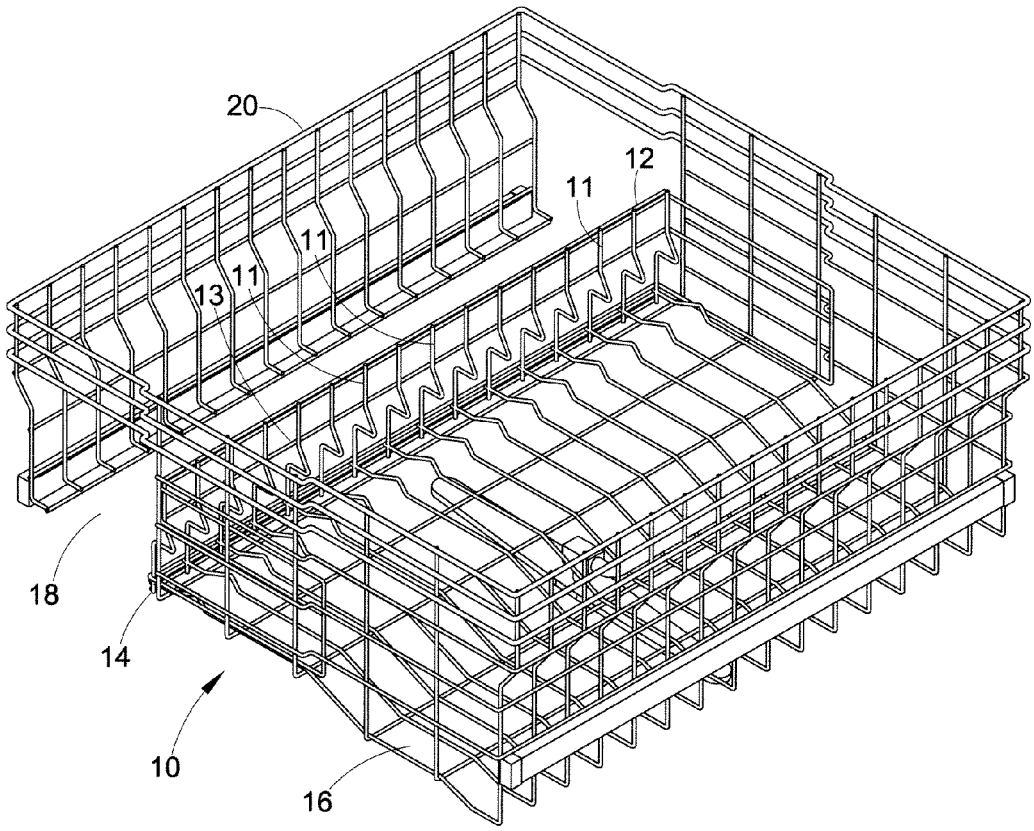
FIG. 2 shows a perspective view of the foldaway rack of FIG. 1 in an opened position rotated about 90 degrees.
Figure 3:
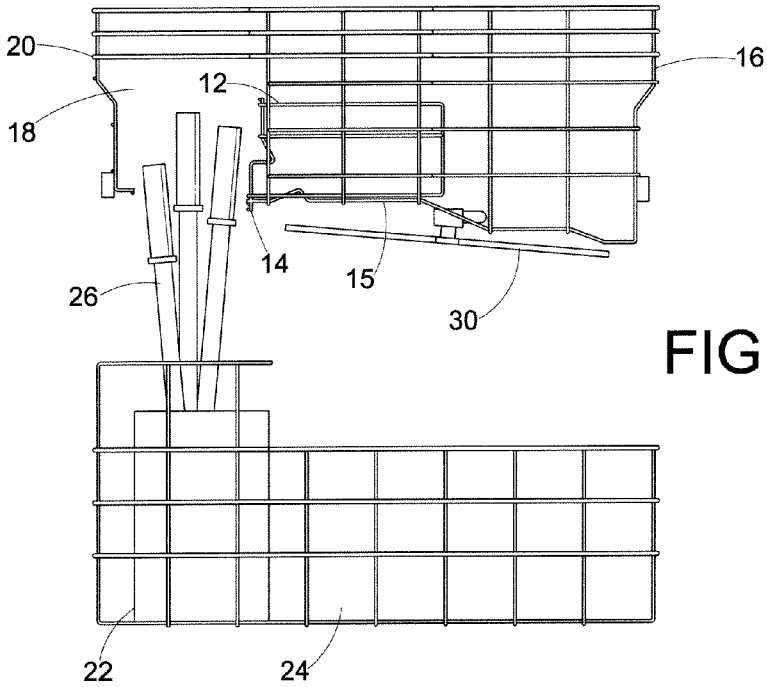
FIG. 3 shows a front view of the foldaway upper rack of FIG. 1 in an opened position with a tall item cage in the bottom rack.

Referring now specifically to FIGS. 1-5, an upper dishwasher rack in accordance with one aspect of the disclosure, includes an upper rack portion 10 in which a portion 12 (which in the illustrative embodiment illustrated in these figures is a left side portion, but which could alternatively be a right side portion) of the upper rack is either detached fully from main upper rack portion 16 and is removed, or is partially detached then rotates along a conventional hinge axis 14 to be folded back and toward the main upper rack portion 16. This "foldaway" or "removable" portion may range in width (designated by reference number "17" in FIG. 5) from approximately 2 inches up to approximately 12 inches of rack width (left to right, as viewed from the front as in FIG. 5). Portion 12 has a plurality of shorter arms or bars 11 spaced along a length of the portion and a plurality of longer arms or bars 13 spaced on a width of the portion. Referring to FIG. 2, when the portion 12 is in the opened position, a gap 18 is formed between main rack portion 16 and a side upper rack portion 20. Referring to FIG. 3, a tall item (e.g. cooking sheet, pan, tall utensil, pizza pan, etc.) plastic or wireform cage 22 can be provided which sits or mounts to a bottom rack 24 of a dishwasher and utilizes the clearance space 18 from the movable upper rack. The cage is specifically intended for items such as tall spatulas and utensils 26, and would keep tall items within a defined space to allow easy sliding motion of upper rack, and to prevent tall utensils from falling out of the intended storage space. A silverware basket can also be placed underneath the foldaway zone to allow clearance for things that are normally loaded into silverware basket, without interfering with mid spray arm or in/out motion of upper rack. Fold down tines can be added to bottom rack to allow placement of the silverware basket.

The utensil stand or cage can be molded to be placed in the foldaway space. The stand can be easily placed onto bottom rack and has fold-down pegs or hooks to hang spatulas. It can also be used to lean large items against (such as cutting boards and cookie sheets). Alternatively, referring to FIG. 4, large cookie sheets, plates or pans 28 may be placed in the lower rack without the need to completely raise or remove the entire upper rack.

Referring to FIG. 3, a spray arm 30 can be reduced in length from about 19 inches to about 14 inches so as not to interfere with the open space 18 formed by moving the foldaway portion 12. Alternatively, the spray arm 30 can be shifted to the right of FIG. 3 or FIG. 4 for clearance for utensils 26 or pans 28 to be positioned in open gap 18.

Figure 4:
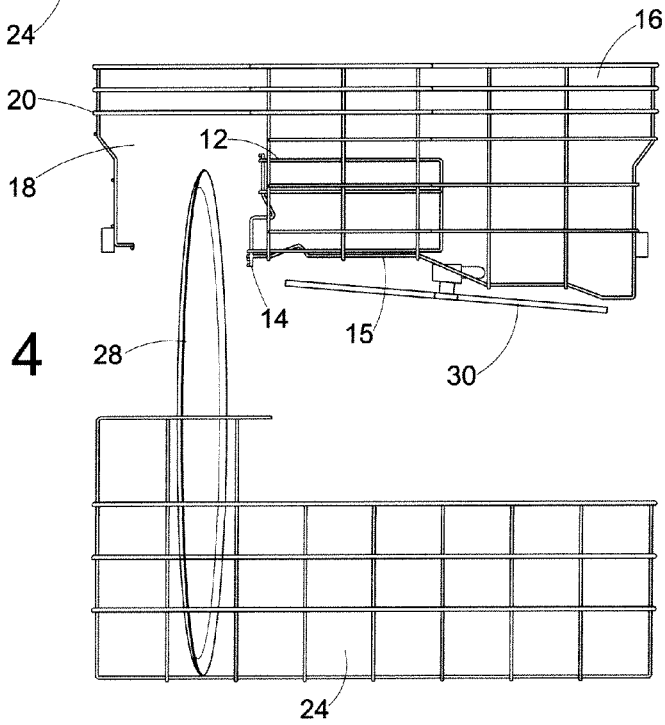
FIG. 4 shows a front view of the foldaway rack of FIG. 1 in an opened position with a large plate in the bottom rack.
Figure 5:
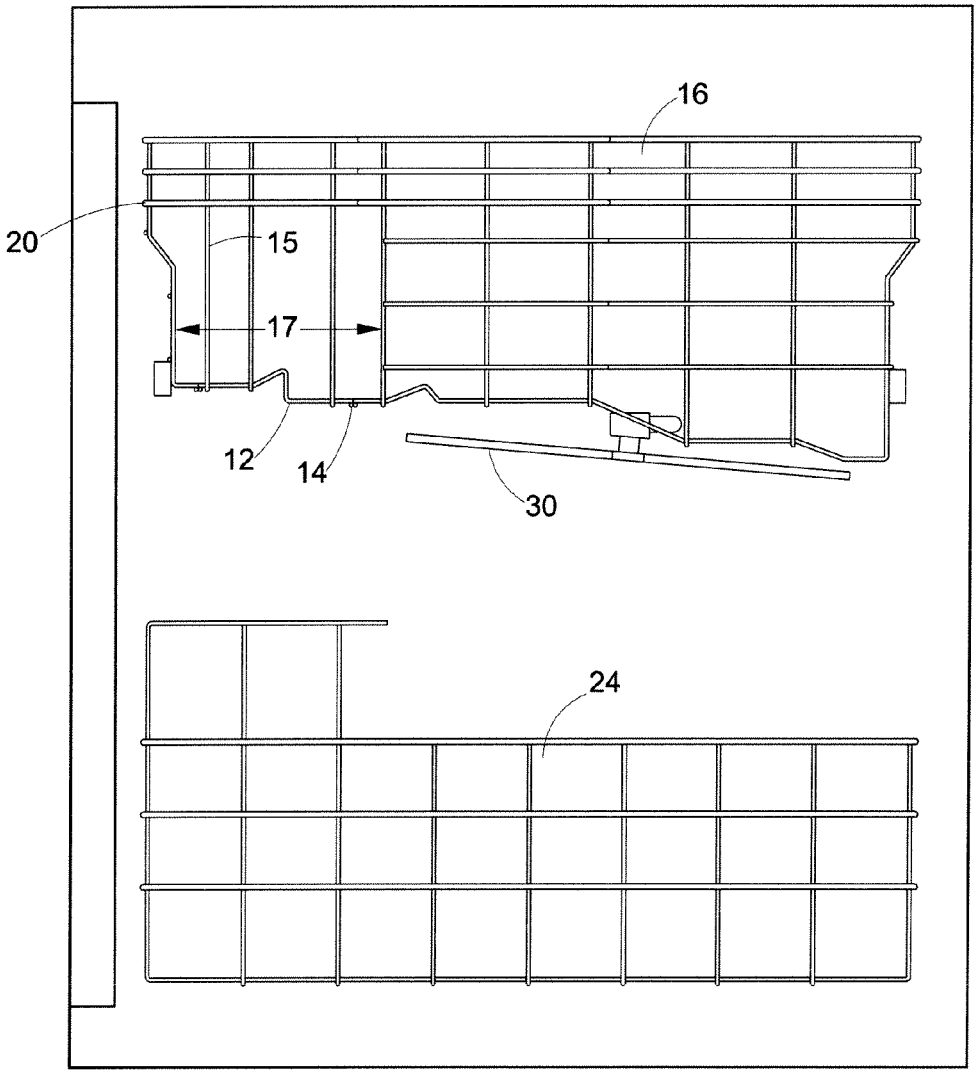
FIG. 5 shows a front view of the foldaway upper rack of FIG. 1 in a closed position.
Figure 6:
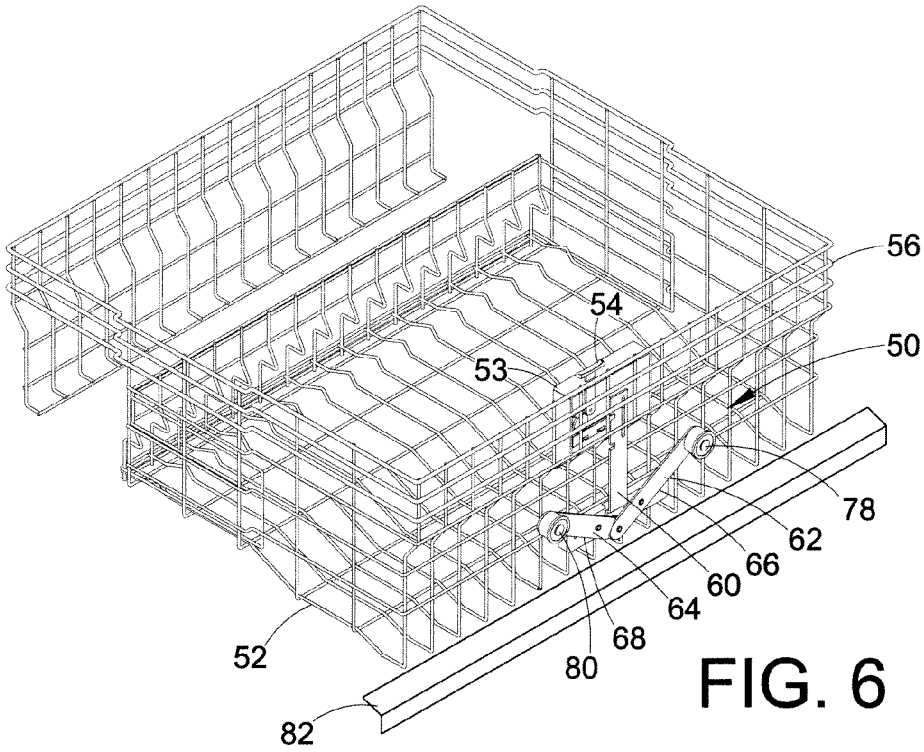
FIG. 6 shows a side perspective view of a vertical adjustment mechanism in a lowered position in accordance with another aspect of the disclosure.
Figure 7:
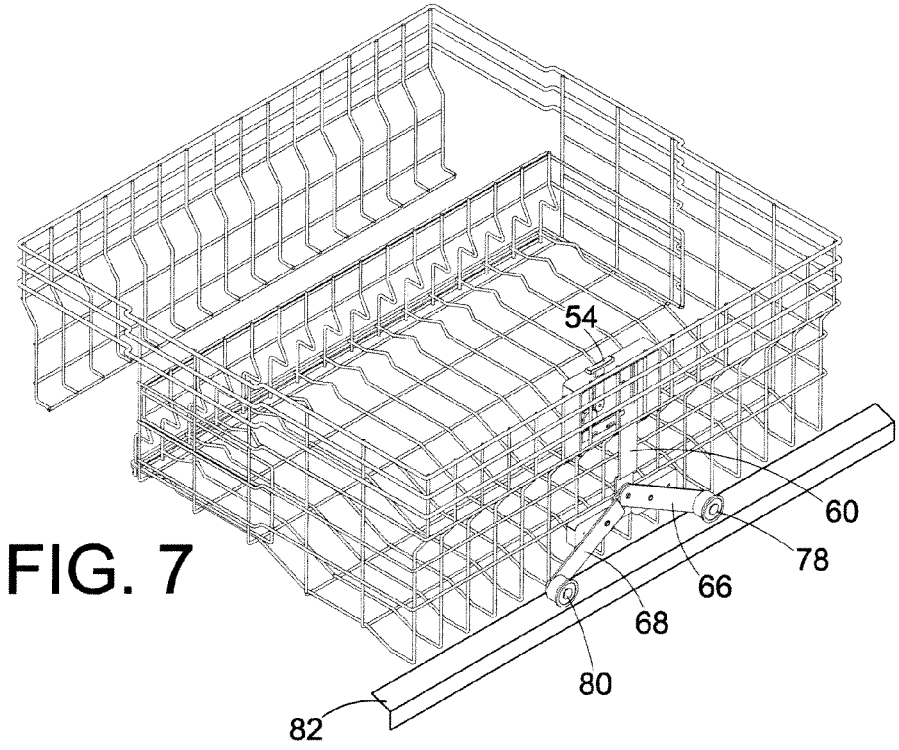
FIG. 7 shows a side perspective view of the vertical adjustment mechanism of FIG. 6 in a raised position.
Figure 8:
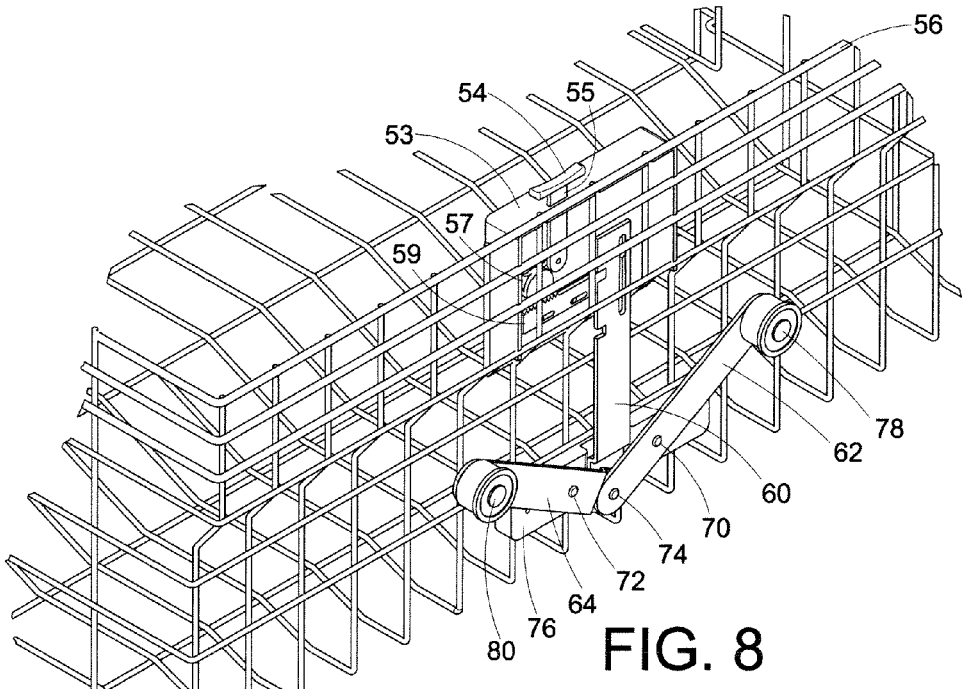
FIG. 8 is an enlarged perspective view of the vertical adjustment mechanism of FIG. 6.
Figure 9:
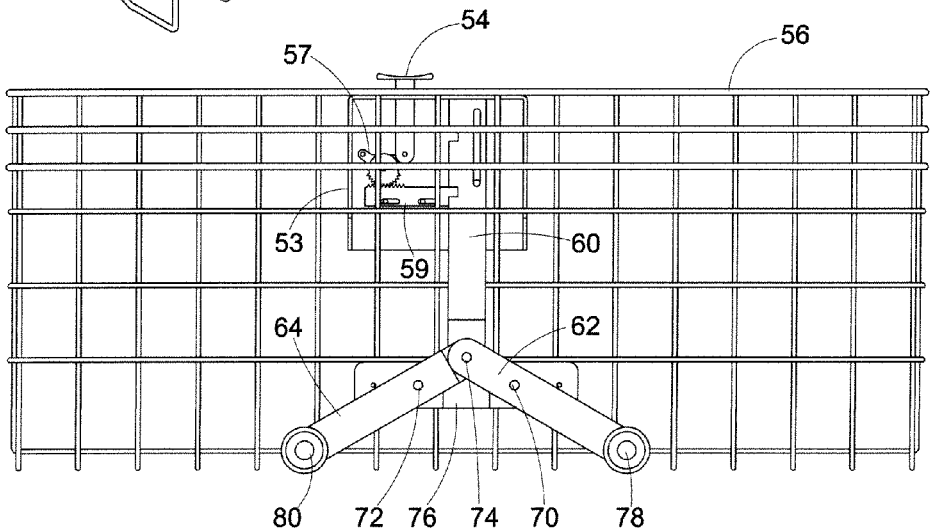
FIG. 9 is a front view of the vertical adjustment mechanism of FIG. 7.

Referring now to FIGS. 3 and 5, the rack portion 12 is rotated about 90 degrees clockwise from a closed position to an opened position (shown in FIGS. 3 and 4). The portion 12 may be latched or snapped into the open position. The user may pull the portion 12 by walls 15 formed on opposite ends of portion 12. Walls 15 are used to complete the outer walls on opposite ends of the upper rack. Likewise, the portion 12 is rotated counterclockwise into the closed position shown in FIG. 5.

The mechanism allows tall items (i.e., greater than approximately 13 inches to be loaded) vertically on side of bottom rack without requiring removal of upper rack, and to allow loading of the tall items without obstructing the intended free-sliding motion in and out of the upper rack system. The foldaway rack can have a clip or some fastening mechanism which is detached then the moving portion of the rack is rotated 90 degrees on a pivot axis (hinge 14) made with the wire rack forms. The rack could also use, as an alternative to the rotating design, a design in which a clip or some fastening mechanism is detached and the moving portion of the rack is lifted or pulled out of place completely. While the illustrative embodiments of FIGS. 1-5 show a single removable or rotatable portion of the upper rack, which as noted hereinbefore could be on the right side instead of the left side as shown, it will be understood that in keeping with the invention, such an upper rack could also include two such portions, one on the left side and one on the right side.

In accordance with another aspect of the disclosure, an adjustable height apparatus for a dishwasher rack is provided which offers a relatively simple and easy to use height adjustment, and is relatively simple to install during rack and dishwasher assembly. Preferably, the adjustable height apparatus is of a symmetrical design such that the same apparatus may be installed upon both left-hand and right-hand sides of the rack, thus further increasing the ease of installation and simplifying the inventory and parts handling process.

The lever-actuated system allows for vertical adjustment of the upper rack through a system of brackets and rivets to provide a ratio of displacement between the slide bracket and wheels, thus allowing greater vertical wheel displacement than other existing lever-actuated designs.

In accordance with another aspect of the disclosure, referring specifically to FIGS. 6-11, a thumb-actuated vertical adjustment mechanism 50 is provided for adjusting the elevation of an upper dishwasher rack 52 by up to 3 inches or more. The mechanism is integrated with or attached to an upper dishwasher rack in which the consumer is provided an ergonomical push-button or lever 54 that releases a spring loaded latch or locking mechanism 59 inside of an enclosed latch and slide bracket system which then allows rack slide wheels to be raised or lowered such that entire upper rack is lowered or raised to a predetermined position corresponding to mechanical detents in the latch and slide system. The present disclosure overcomes geometric obstacles by providing displacement amplification through a system of riveted brackets such that a displacement within the enclosed latch and slide system of 1 inch (for example) yields a rack vertical adjustment of 3 inches or more. This allows the consumer to place a 12-inch plate into the upper rack, thus providing more dishwasher loading options to the consumer. In contrast, existing designs for vertical upper-rack adjustment allows for the consumer to adjust the upper rack with a 1-inch displacement which allows for no more than a 10-inch plate to be placed in the rack.

Figure 10:
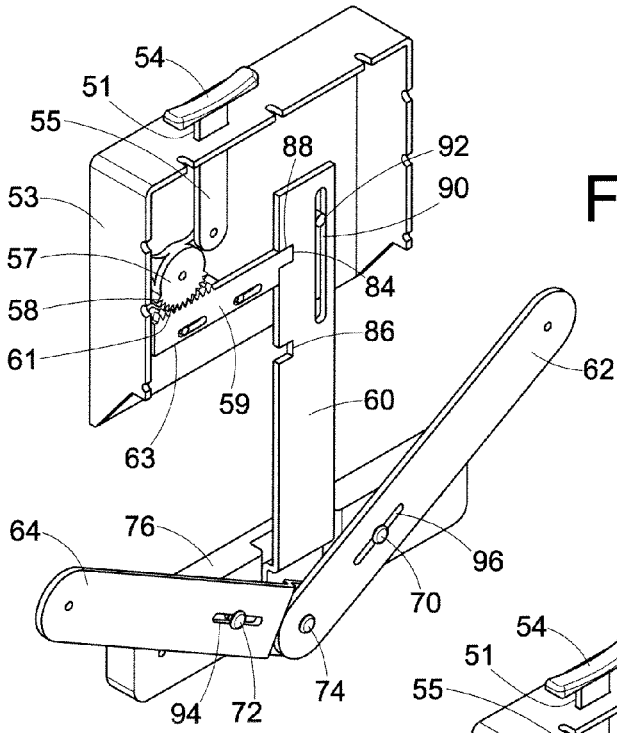
FIG. 10 is an enlarged side perspective view of the mechanism of FIG. 6.
Figure 11:
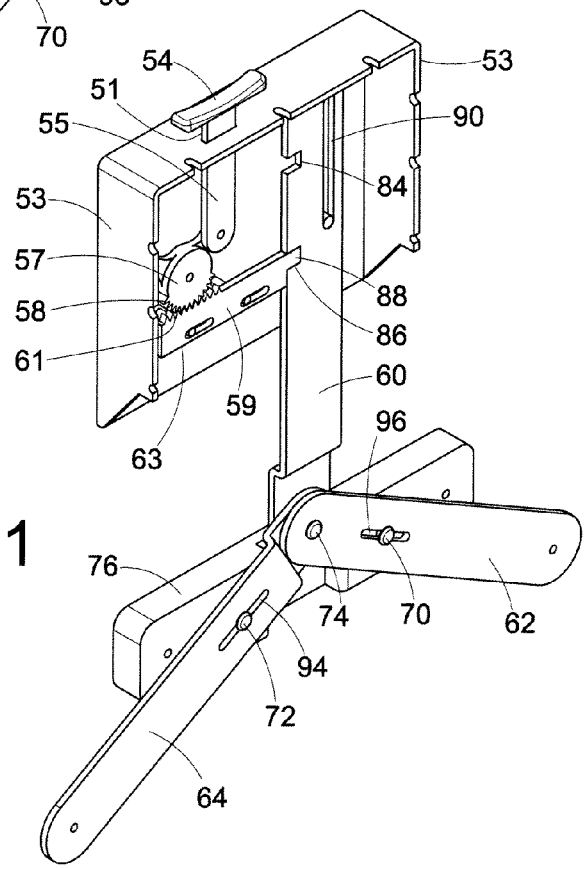
FIG. 11 is an enlarged perspective view of the mechanism of FIG. 7.

Specifically, referring to FIGS. 10 and 11, the vertical adjustment system provides a handle 51 having an ergonomic thumb pad 54 at an upper side 56 of the upper rack 52. Though only one adjustment mechanism, the right side mechanism, is illustrated in the drawings, it is to be understood that a second such mechanism is to be provided on the left side of the rack. The vertical adjustment system is preferably housed within a housing 53. When the thumb-pad is actuated or depressed by the user, it releases a spring loaded latch or locking system 59 which is biased to contact slide bracket 60, thus unlatching slide bracket, thus allowing the rack to be raised or lowered to predetermined detented elevations. Specifically, the slidable bracket has at least two notches 84, 86 which engage a corresponding tab or protrusion 88 of pinion 63. When the thumb pad is depressed, the pinion is moved away from engagement of the protrusion 88 with one of the notches 84, 86 of the slide bracket. The slidable bracket is then slid vertically until another one of the notches 84,86 aligns with tab 88. In the raised position, notch 86 is aligned with the tab 88, and in the lowered position, notch 84 aligns with and engages tab 88. Slidable bracket further has an elongated slot 90, which can receive an alignment pin 92 within housing 53 which aids in smooth vertical movement of the bracket between the raised and lowered positions. Releasing the thumb-pad allows the latching protrusion 88 to re-engage one of the notches 84, 86 the slide bracket 60, thus fixing the elevation of the upper rack. The thumb pad includes an elongated arm 55 which engages an end of a molded actuation gear 57 having teeth 58 along at least a portion of an outer edge thereof. The molded latch pinion 63 has teeth 61 which interengage with teeth 58 of gear 57. The gear, latch pinion and a portion of the slide bracket are all enclosed within the housing 53. When the thumb pad is depressed, the gear rotates clockwise, (in FIGS. 10 and 11) and the meshing teeth move the latch pinion 63 out of contact with the bracket. The gear and latch pinion are spring biased to contact the slide bracket. Thus, when the thumb pad is released, the pinion slides or moves toward the slide bracket, thus resulting in protrusion 88 contacting one of notches 84, 86.

Extending from the slide bracket are two elongated arms 62, 64 which form stamped wheel brackets 66, 68 and which extend in opposite directions. Rivets 70, 72, 74 are used to secure the slide bracket arms 62, 64 to the slide bracket and a stamped pivot side plate 76 which is secured to the upper rack. The wheel brackets 66, 68 have at distal ends wheels 78, 80 which engage a track or rail 82 in the dishwasher.

Due to the intricacies of the clearances and geometry of the rack slides, slide wheels and rack, the mechanism involves the use of 2 pivot points (at rivets 70, 72) and relies on mechanical amplification of the slide bracket to achieve a large vertical height adjustment of 3 inches or more by vertically sliding the bracket one inch. Traditional "T-bracket" systems cannot provide such a large adjustment range without significant design compromises of the rack system. FIG. 10 shows the bracket 60 in a lowered position, wherein the wheel brackets support wheels 78, 80 in a lowered rack position on a rail 82. FIG. 11 shows the bracket 60 in a raised rack position, wherein the wheel brackets support wheels 78, 80 in a raised position on rail 82.

In one embodiment, rivet 74 is fixed and it pivotally connects the first slide bracket arm 62 to the second slide bracket arm 64. To enable movement of the bracket arms 62, 64, rivets 70, 72 are moveable; they translate along slots 94, 96 formed in the stamped pivot side plate 76. When the racket is in the lowered position, as shown in FIG. 10, the moveable rivets 70, 72 are situated at the innermost portion of the slots 94, 96. When the racket is lifted to a raised position, as shown in FIG. 11, the moveable rivets 70, 72 translate the length of the slots 94, 96 to their outermost portions.

Figure 12:
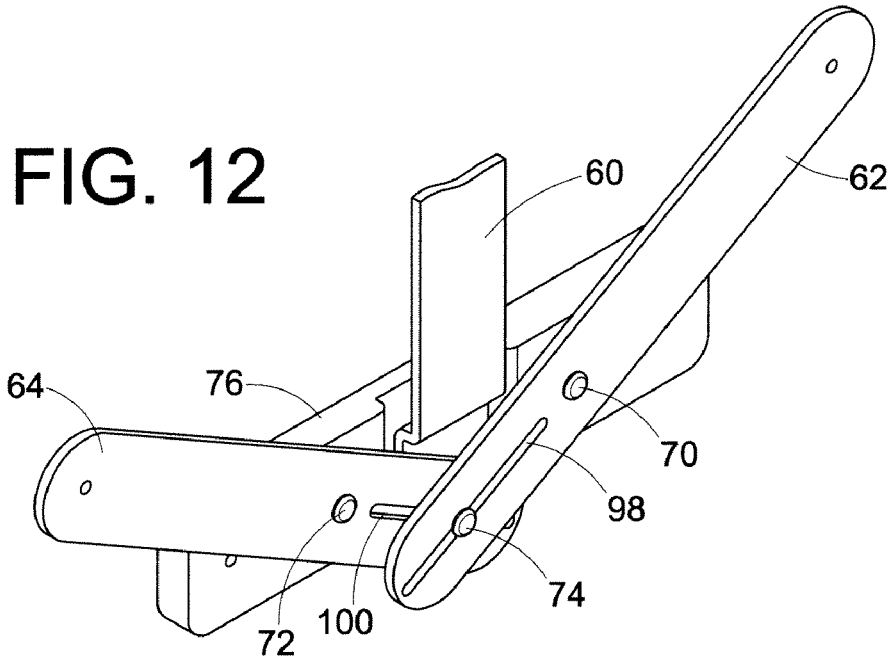
FIG. 12 is an enlarged partial perspective view of another embodiment of the mechanism; and, FIG. 13 is an enlarged partial perspective view of the mechanism of FIG. 12.
Figure 13:
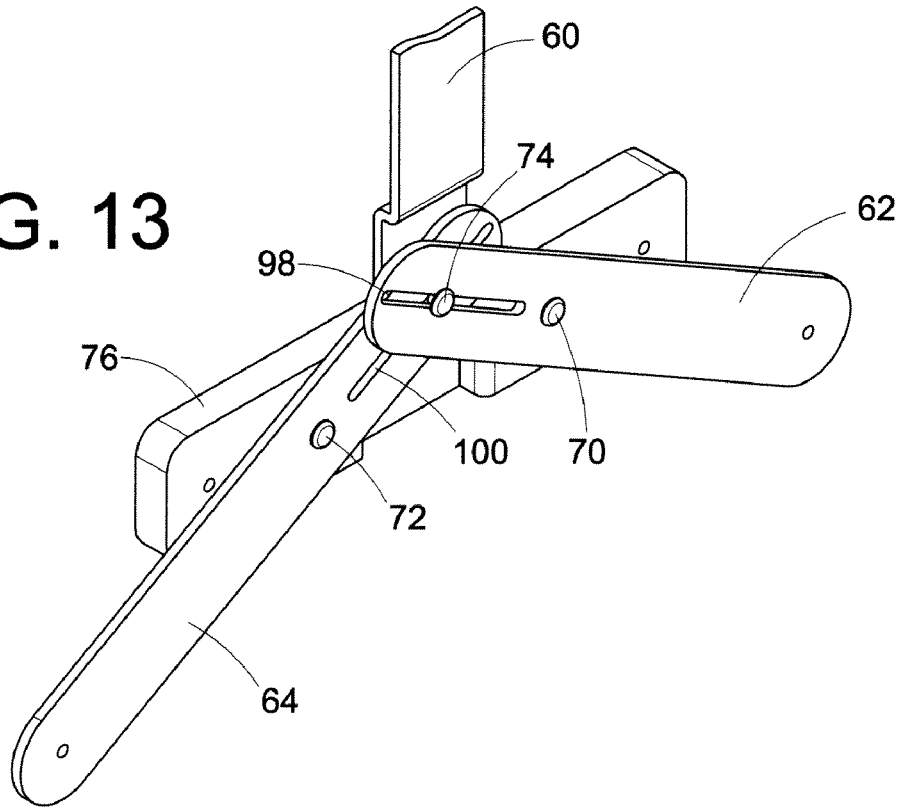

In another embodiment, shown in FIGS. 12 and 13, rivets 70, 72 are fixed and they pivotally connect the bracket arms 62, 64 to the stamped pivot side plate 76. To enable pivotal movement of the bracket arms 62, 64 with respect to each other, rivet 74 is moveable. Rivet 74 translates along first and second slots 98, 100 formed in the bracket arms 62, 64. When the racket is in the lowered position, as shown in FIG. 12, the moveable rivet 74 is situated at the outermost portion of the first slot 98 of one arm 62 and the innermost portion of the second slot 100 of the other arm 64. When the racket is lifted to a raised position, as shown in FIG. 13, the moveable rivet 74 translates the length of both slots 98, 100 such that it is situated at the innermost portion of the first slot 98 of the one arm 62 and the outermost portion of the second slot 100 of the other arm 64.

Furthermore, the system easily accommodates multiple elevation detents, from 2 to 10 or more detents, as well as increased adjustment ranges beyond 3 inches, thus allowing easy model differentiation.

In order to allow the remaining (non-removable) upper rack system to support a full load of dishware, the structure of the rack remains such that roller wheels and slides are still utilized on both the left and right sides of the rack. The load-bearing rack structure is proposed to rise above and over the removable portion, then back down to the wheels and rack slide system to accommodate the dish weight. However, the structure allows tall items to be loaded into the extra tall clearance space from the front, and allows the upper rack to be slid in or out without the tall items obstructing the rack slide motion. The displacement of three inches allows a 12-inch plate to be placed on the upper rack.

The invention has been described with reference to the preferred embodiments. Obviously, modifications and alterations will occur to others upon reading and understanding the preceding detailed description. It is intended that the invention be construed as including all such modifications and alterations.

What is claimed is:

1. An upper rack vertical adjustment system for a dishwasher of the type having at least an upper rack and a lower rack, comprising:

an upper rack comprising a vertically extending front wall, a back wall, two opposing sidewalls and a bottom wall, said bottom wall including a first portion and a second portion;

said second portion rotatably attached to said first portion for movement between a first position in which said second portion is operative to serve as a portion of the bottom wall and a second position in which said second portion is operative to create an extended opening in the bottom wall thereby providing vertical clearance for objects stored in the lower rack;

a slidable member having two elongated aims extending therefrom wherein each of said elongated arms comprises a wheel attached at an end of one of said arms;

a plate mounted to a portion of said upper rack wherein said slidable member is pivotally mounted to said plate; and a locking mechanism for locking said slidable member in one of several predetermined positions.

2. The upper rack adjustment system of claim 1, wherein said upper rack second portion rotates about 90 degrees between said first position and said second position.

3. The upper rack adjustment system of claim 2, wherein said upper rack second portion is positioned approximately 90 degrees with respect to said first portion in said second position.

4. The upper rack adjustment system of claim 1, wherein said second portion of said upper rack extends over a portion of a width of said upper rack.

5. The upper rack adjustment system of claim 4, wherein the width of said second portion is between 2 and 12 inches.

6. The upper rack adjustment system of claim 1, further comprising a container for holding tall utensils installed on the lower rack.

7. The upper rack adjustment system of claim 1, further comprising latches for securing said upper rack second portion in said first or second positions.

8. An upper rack vertical adjustment system comprising:

a slidable member having two elongated arms extending therefrom wherein each of said elongated arms comprises a wheel attached at an end of one of said arms;

a plate mounted to a portion of said upper rack wherein said slidable member is pivotally mounted to said plate; and a locking mechanism for locking said slidable member in one of several predetermined positions.

9. The upper rack adjustment system of claim 8, further comprising a handle which is connected to said locking mechanism and is depressed to release said slidable member from said locking mechanism.

10. The upper rack vertical adjustment system of claim 9, wherein said handle comprises an ergonomic thumb pad.

11. The upper rack vertical adjustment system of claim 8, wherein said locking mechanism comprises a gear and pinion which have interengaging teeth.

12. The upper rack vertical adjustment system of claim 11, wherein said gear and pinion are housed within a housing assembly.

13. The upper rack vertical adjustment system of claim 11, wherein said slidable member comprises a first notch and a second notch, wherein said first notch corresponds to a raised position of said upper rack of said second notch corresponds to a lowered position of said upper rack.

14. The upper rack vertical adjustment system of claim 13, wherein said pinion comprises a protrusion.

15. The upper rack vertical adjustment system of claim 14, wherein when said handle is depressed, one of said notches of said slidable member is released from engagement with said protrusion of said pinion and said slidable bracket is raised or lowered until another of said notches engages said protrusion of said pinion.

16. The upper rack vertical adjustment system of claim 15, wherein said locking mechanism is spring biased to a locked position.

17. The upper rack vertical adjustment system of claim 8, wherein said elongated arms of said slidable member are pivotally attached to said plate via fasteners.

18. The upper rack vertical adjustment system of claim 8, wherein said elongated arms of said slidable member pivot about an end of a vertical portion of said slidable member.

19. The upper rack vertical adjustment system of claim 18, wherein said wheels of said elongated aims engages an associated rack of said dishwasher.

20. The upper rack vertical adjustment system of claim 8, wherein said slidable member and locking assembly is provided on opposite ends of an associated upper rack.

21. The upper rack vertical adjustment system of claim 20, wherein said slidable member comprises an elongated slot which receives a pin for aligning and sliding the slidable member in a vertical direction.

22. A dishwasher of the type having at least an upper rack and a lower rack, the upper rack comprising adjustment means for support of taller dishware on the upper and lower racks, said adjustment means comprising:

a first adjustment mechanism on a bottom wall of said upper rack for removal of a least a portion of said upper rack such that the taller dishware load onto said lower rack; and, a second adjustment mechanism on opposite ends of said upper rack for adjustment of a height of said upper rack such that the taller dishware load onto said upper rack, wherein the second adjustment mechanism includes:

a slidable member having two elongated arms extending therefrom wherein each of said elongated arms comprises a wheel attached at an end of one of said arms, each said wheel engages said upper rack of said dishwasher;

a plate mounted to a portion of said upper rack wherein said slidable member is pivotally mounted to said plate; and a locking mechanism for locking said slidable member in one of several predetermined positions.

23. The dishwasher of claim 22, wherein the bottom wall of said upper rack is defined by a first portion and a second portion, said second portion being rotatably attached to said first portion for movement between a first position in which said second portion is operative to serve as a portion of the bottom wall and a second position in which said second portion is operative to create an extended opening in the bottom wall thereby providing vertical clearance for objects stored in the lower rack.

24. The dishwasher of claim 22, wherein the second adjustment mechanism further includes:

a depressible handle connected to said locking mechanism, said handle releases said slideable member from said locking mechanism;

a gear and a pinion included on said locking mechanism and housed within said housing assembly;

a first notch and a second notch on said slidable member, each of said notches corresponds to different raised and lowered positions of said upper rack;

a pinion with a protrusion; and, a slot in said slideable member which receives a pin for aligning and sliding the slideable member in a vertical direction;

wherein when said handle is depressed, one of said notches of said slidable member releases from engagement with said protrusion of said pinion and said slidable bracket raises or lowers until another of said notches engages said protrusion of said pinion.

25. The dishwasher of claim 24, wherein said elongated arms of said slidable member pivot about an end of a vertical portion of said slidable member.

* * * * *